US007993175B2

(12) United States Patent
Hiroshima et al.

(10) Patent No.: US 7,993,175 B2
(45) Date of Patent: Aug. 9, 2011

(54) OUTBOARD MOTOR CONTROL SYSTEM

(75) Inventors: Naoki Hiroshima, Wako (JP); Yoshihiko Yamagishi, Wako (JP); Yoshinori Masubuchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 459 days.

(21) Appl. No.: 11/977,964

(22) Filed: Oct. 26, 2007

(65) Prior Publication Data

US 2008/0119095 A1 May 22, 2008

(30) Foreign Application Priority Data

Nov. 20, 2006 (JP) ..... 2006-313463

(51) Int. Cl.
*B63H 25/00* (2006.01)

(52) U.S. Cl. ..... 440/84

(58) Field of Classification Search ..... 440/84, 440/86, 87; 114/144 RE
See application file for complete search history.

(56) References Cited

U.S. PATENT DOCUMENTS

| | | | | |
|---|---|---|---|---|
| 2,749,035 | A | 6/1956 | Gray | |
| 3,301,510 | A | 1/1967 | Cook | |
| 6,234,853 | B1 | 5/2001 | Lanyi et al. | |
| 6,994,046 | B2 | 2/2006 | Kaji et al. | |
| 6,997,764 | B2 | 2/2006 | Okuyama et al. | |
| 7,220,153 | B2 * | 5/2007 | Okuyama | 440/1 |
| 7,402,090 | B2 | 7/2008 | Okuyama | |
| 7,429,202 | B2 | 9/2008 | Yazaki et al. | |
| 2005/0245145 | A1 * | 11/2005 | Takada et al. | 440/1 |

FOREIGN PATENT DOCUMENTS

| | | |
|---|---|---|
| JP | 2000-313398 A | 11/2000 |
| JP | 2003-127986 | 5/2003 |
| JP | 2004-052697 | 2/2004 |
| JP | 2005-161906 A | 6/2005 |
| JP | 2005-319967 | 11/2005 |
| JP | 2006-142880 | 6/2006 |
| JP | 2006-312375 A | 11/2006 |

* cited by examiner

*Primary Examiner* — Ed Swinehart
(74) *Attorney, Agent, or Firm* — Carrier Blackman & Associates, P.C.; Joseph P. Carrier; William D. Blackman

(57) ABSTRACT

In a system for controlling outboard motors each mounted on a boat and each having an engine, a steering mechanism, a shift mechanism, an actuator driving at least one of the steering mechanism, the shift mechanism and a throttle valve of the engine, and a controller controlling operation of the actuator, comprising: a steering wheel operable by an operator; a shift/throttle lever operable by the operator; and a manipulated variable detector producing an output indicative of manipulated variable of at least one of the steering wheel and the shift/throttle lever; the manipulated variable detector being separately connected to each of the controllers in the outboard motors through an electric signal line to send the output to the controllers. With this, it becomes possible to control the operation of the actuators in the outboard motors separately for the individual outboard motors with simple structure without identifying the respective outboard motors.

20 Claims, 9 Drawing Sheets

PRIOR ART

PRIOR ART

OUTBOARD MOTOR CONTROL SYSTEM

BACKGROUND OF THE INVENTION

1. Field of the Invention

This invention relates to an outboard motor control system.

2. Description of the Related Art

In recent years, there are proposed drive-by-wire (DBW) control systems that use actuators for driving a steering mechanism, shift mechanism and throttle valve of an internal combustion engine mounted on an outboard motor, as taught by, for example, Japanese Laid-Open Patent Application No. 2003-127986 (particularly paragraphs 0021 to 0026, 0043 to 0045, FIGS. 1, 2, etc.).

As described in another Japanese Laid-Open Patent Application No. 2004-52697 ('697; particularly paragraphs 0014 to 0017, FIG. 1, etc.), boats are commonly equipped with two or more outboard motors mounted side-by-side in what is called a "multiple outboard motor installation." In this technique, sensors installed in a boat to detect manipulated variables of its steering wheel and shift/throttle lever and control units installed in individual multiple outboard motors to control the operation of actuators, are connected in series through an electric signal line.

With this configuration in which the sensors and control units installed in multiple outboard motors are connected in series through the electric signal line, as described in '697, when the operation of the actuators is controlled for each of the outboard motors, it needs to identify the respective outboard motors, i.e., to rewrite software for each of the outboard motors, resulting in increase of complicated tedious work.

SUMMARY OF THE INVENTION

An object of this invention is therefore to overcome this problem by providing an outboard motor control system that can control the operation of actuators installed in respective multiple outboard motors for each of the outboard motors with simple structure.

In order to achieve the object, this invention provides a system for controlling a plurality of outboard motors each adapted to be mounted on a stem of a boat and each having an internal combustion engine, a steering mechanism, a shift mechanism, an actuator adapted to drive at least one of the steering mechanism, the shift mechanism and a throttle valve of the engine, and a controller to control operation of the actuator, comprising: a steering wheel installed to be freely operable by an operator; a shift/throttle lever installed to be freely operable by the operator; and a manipulated variable detector adapted to produce an output indicative of manipulated variable of at least one of the steering wheel and the shift/throttle lever by the operator; the manipulated variable detector being separately connected to each of the controllers installed in the outboard motors through an electric signal line to send the output to each of the controllers.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An outboard motor control system according to preferred embodiments of this invention will now be explained with reference to the attached drawings.

Figure 1:
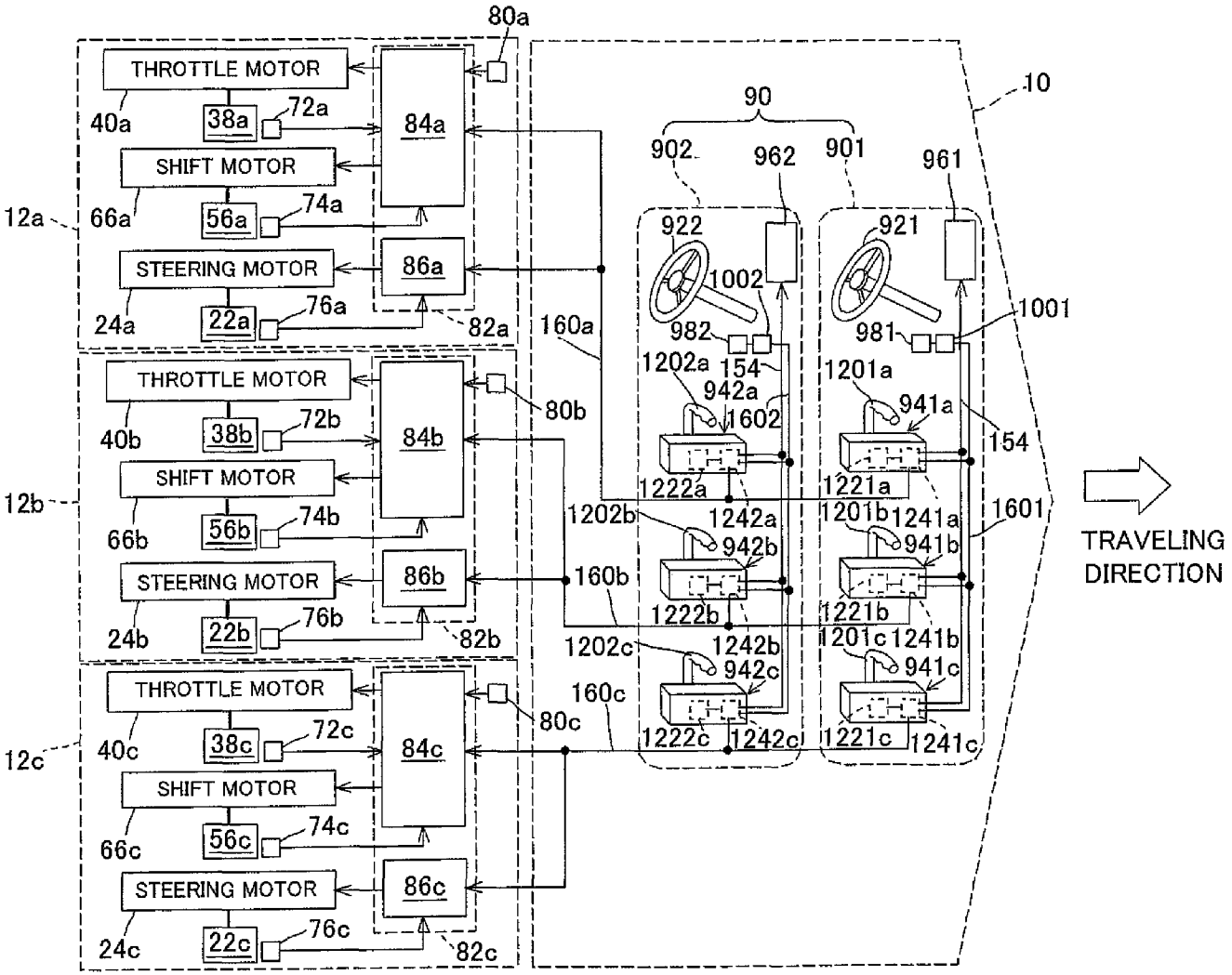
FIG. 1 is a block diagram showing an outboard motor control system according to a first embodiment of this invention.

FIG. 1 is a block diagram showing an outboard motor control system according to a first embodiment of this invention.

As shown in FIG. 1, a plurality of, more precisely three outboard motors 12*a, b, c* are mounted on the stem of a boat or hull 10. In other words, the boat 10 has what is known as a multiple or triple outboard motor installation. In the following, the port side outboard motor 12*a*, i.e., outboard motor on the left side when looking in the direction of forward travel is called the "port outboard motor", outboard motor 12*b* in the middle of the boat the "middle outboard motor" and the starboard side outboard motor 12*c*, i.e., outboard motor on the right side the "starboard outboard motor."

Figure 2:
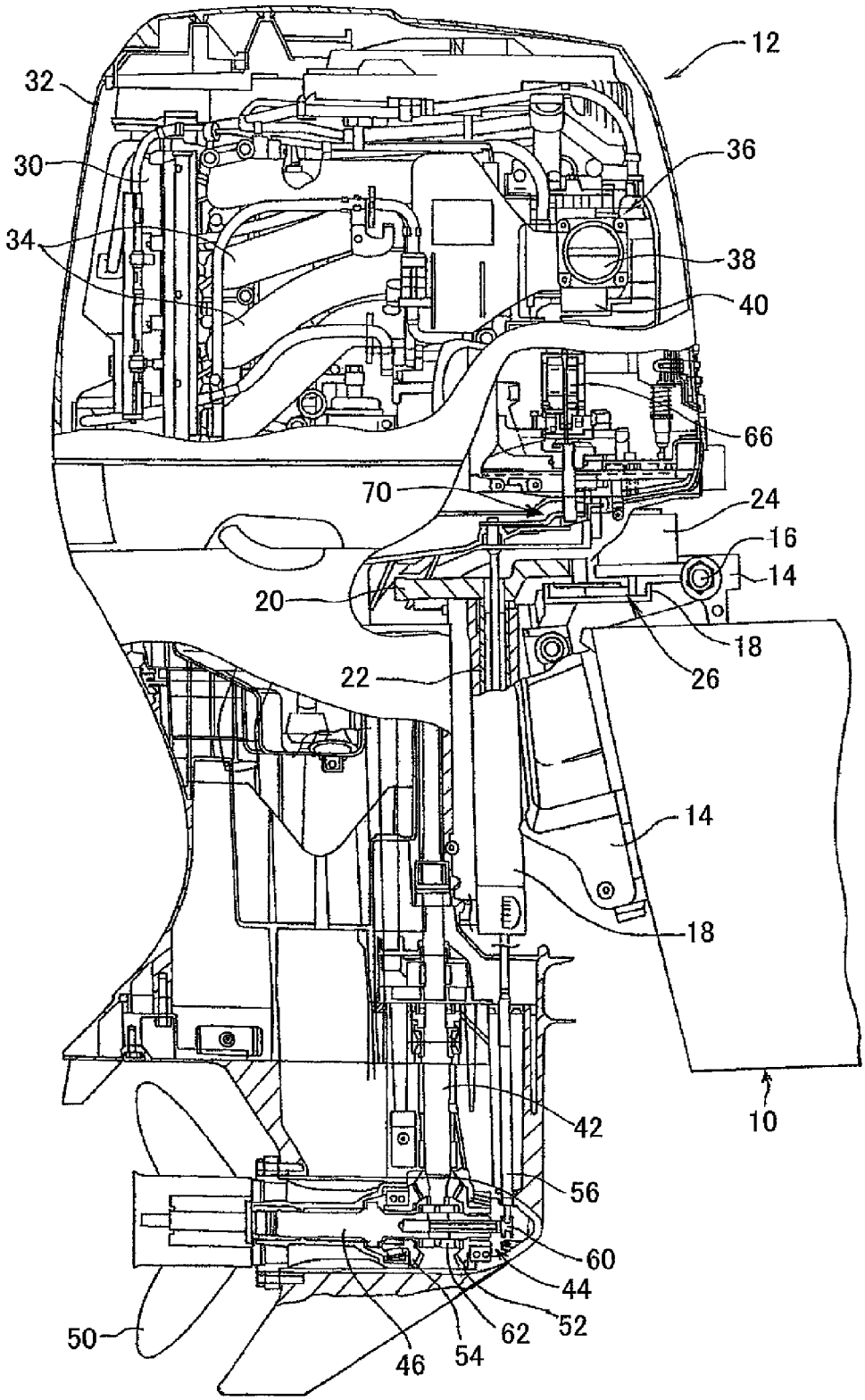
FIG. 2 is an enlarged cross-sectional side view partially showing an outboard motor shown in FIG. 1.

FIG. 2 is an enlarged cross-sectional side view partially showing the outboard motor shown in FIG. 1. Since the configurations of the port outboard motor 12*a*, middle outboard motor 12*b* and starboard outboard motor 12*c* are the same, the following explanation with reference to FIG. 2 will be made without indications of a, b and c unless necessary to distinguish the three outboard motors.

As shown in FIG. 2, the outboard motor 12 is equipped with stem brackets 14 fastened to the stem of the boat 10. A swivel case 18 is attached to the stem brackets 14 through a tilting shaft 16. A mount frame (steering mechanism) 20 installed in the outboard motor 12 is equipped with a shaft 22. The shaft 22 is housed in the swivel case 18 to be freely rotated about the vertical axis. The upper end of mount frame 20 and lower end thereof, i.e., lower end of the shaft 22 are fastened to a frame (not shown) constituting a main body of the outboard motor 12.

The upper portion of the swivel case 18 is installed with an electric steering motor (steering actuator) 24 that drives the shaft 22. The output shaft of the steering motor 24 is connected to the upper end of mount frame 20 via a speed reduction gear mechanism 26. Specifically, a rotational output generated by driving the steering motor 24 is transmitted via the speed reduction gear mechanism 26 to the mount frame 20 such that the outboard motor 12 is steered about the shaft 22 as a rotational axis to the right and left directions (i.e., steered about the vertical axis). Thus the mount frame 20 functions as the "steering mechanism" that uses the steering motor 24 to steer the outboard motor 12 laterally.

The outboard motor 12 is equipped with an internal combustion engine (hereinafter referred to as "engine") 30 at its upper portion. The engine 30 comprises a spark-ignition water-cooled gasoline engine with a displacement of 2,200 cc. The engine 30 is located above the water surface and covered by an engine cover 32.

The engine 30 has an intake pipe 34 that is connected to a throttle body 36. The throttle body 36 has a throttle valve 38 installed therein and an electric throttle motor (throttle actuator) 40 is integrally disposed thereto to open and close the throttle valve 38. The output shaft of the throttle motor 40 is connected to the throttle valve 38 via a speed reduction gear mechanism (not shown) installed near the throttle body 36. Specifically, the throttle motor 40 is operated to open and close the throttle valve 38, thereby regulating air sucked in the engine 30 to control the engine speed.

The outboard motor 12 is equipped with a drive shaft 42 installed in parallel with the vertical axis and supported to be freely rotated thereabout. One end, i.e., the upper end of the drive shaft 42 is connected to a crankshaft (not shown) of the engine 30 and the other end, i.e., the lower end thereof is connected via a shift mechanism 44 with a propeller shaft 46 supported to be freely rotated about the horizontal axis. One end of the propeller shaft 46 is attached with the propeller 50.

The shift mechanism 44 comprises a forward bevel gear 52 and reverse bevel gear 54 which are connected to the drive shaft 42 to be rotated, and a clutch 62 which is rotated integrally with the propeller shaft 46 and is freely engaged with either one of the forward bevel gear 52 and reverse bevel gear 54 by displacement of a shift rod 56 and shift slider 60.

The interior of the engine cover 32 is disposed with an electric shift motor (shift actuator) 66 that drives the shift mechanism 44. The output shaft of the shift motor 66 is freely connected via a speed reduction gear mechanism 70 with the upper end of the shift rod 56 of the shift mechanism 44. Therefore, when the shift motor 66 is driven, its output displaces the shift rod 56 and shift slider 60, thereby driving the clutch 62 to be engaged with either the forward bevel gear 52 or the reverse bevel gear 54.

The rotational output of the drive shaft 42 is transmitted via the shift mechanism 44 to the propeller shaft 46 to rotate the propeller 50 in one of the directions making the boat 10 move forward or rearward. The engagement of the clutch 62 with one of the bevel gears 52, 54 can be released by driving the shift motor 66 to displace the shift slider 60 to an appropriate position. Specifically, the shift motor 66 is driven to operate the clutch 62 of the shift mechanism 44, thereby switching the shift position among forward, reverse and neutral positions.

Thus the outboard motor 12 is configured such that the steering mechanism (mount frame) 20, shift mechanism 44 and throttle valve 38 of the mounted engine 30 are operated by the motors 24, 40, 66. The outboard motor 12 is equipped with a power source (not shown) such as a battery or the like attached to the engine 30 to supply operating power to the motors 24, 40, 66, a lever position sensor unit (explained later) and other components.

The explanation of FIG. 1 will be resumed. The three outboard motors 12 are each equipped with a throttle opening sensor 72. The throttle opening sensor 72 is installed near the throttle valve 38 and produces an output or signal indicative of throttle opening. The each outboard motor 12 is further equipped with a shift position sensor 74 and rudder angle sensor 76.

The shift position sensor 74 is installed near the shift rod 56 and produces an output or signal indicative of shift position, i.e., rotation angle of the shift rod 56. The rudder angle sensor 76 installed near the shaft 22 produces an output or signal indicative of rotation angle of the shaft 22, i.e., steering angle of the outboard motor 12. Each of the outboard motors 12 is further equipped with a crank angle sensor 80 installed near the crankshaft of the engine 30 to produce an output or signal indicative of engine speed of the engine 30.

The three outboard motors 12 are equipped with ECUs (electronic control unit) 82*a, b, c* (assigned by reference numeral 82 when collectively called in the following). The ECU 82 is constituted as a microcomputer including a CPU, ROM, RAM and other devices and mounted in the engine cover 32 of the outboard motor 12. The ECU 82 comprises an engine control unit or engine controller 84 that controls the operation of the throttle motor 40 and shift motor 66, and an steering control unit or steering controller 86 that controls the operation the steering motor 24.

As shown in FIG. 1, among the outputs of the forgoing sensors, the outputs of the throttle opening sensor 72, shift position sensor 74 and crank angle sensor 80 are sent to the engine control unit 84 and the output of the rudder angle sensor 76 is sent to the steering control unit 86.

The boat 10 is equipped with multiple, more precisely two in this embodiment, navigation units 90 installed to be freely manipulated by the operator. In the following, the navigation unit with reference numeral 90 having a suffix 1, namely 901, will be called the first navigation unit and the navigation unit with 90 having a suffix 2, namely 902, will be called the second navigation unit.

The first and second navigation units 901, 902 produce outputs or signals indicative of drive commands for the aforementioned motors in response to manipulation by the operator. Specifically, the first navigation unit 901 comprises a steering wheel 921 disposed to be freely rotated or manipulated by the operator, a plurality of, i.e., three remote control boxes 941*a, b, c*, and an indicator 961 that indicates the current wheel steering angle, boat speed and the like. Similarly, the second navigation unit 902 comprises a steering wheel 922, a plurality of, i.e., three remote control boxes 942*a, b, c*, and an indicator 962.

Among the six remote control boxes, the remote control boxes 941*a*, 942*a* produce outputs or signals indicating drive commands for the port outboard motor 12*a*, the remote control boxes 941*b*, 942*b* for the middle outboard motor 12*b*, and the remote control boxes 941*c*, 942*c* for the starboard outboard motor 12*c*, respectively.

The steering wheels 921, 922 are used or rotated by the operator to input rudder turning commands to the outboard motors 12, i.e., commands for operating the steering motors 24. Steering angle sensors (steering sensor; manipulated variable detector; steering angle detector) 981, 982 installed near the rotary shafts of the steering wheels 921, 922 produce outputs or signals indicative of the manipulated variables, namely, steering angles of the steering wheels 921, 922 manipulated by the operator.

The steering angle sensors 981, 982 are connected to steering angle sensor units (steering sensor unit; manipulated variable detector; steering angle detector) 1001, 1002, respectively, that are inputted with the outputs indicative of steering angles detected by the steering angle sensors.

Figure 3:
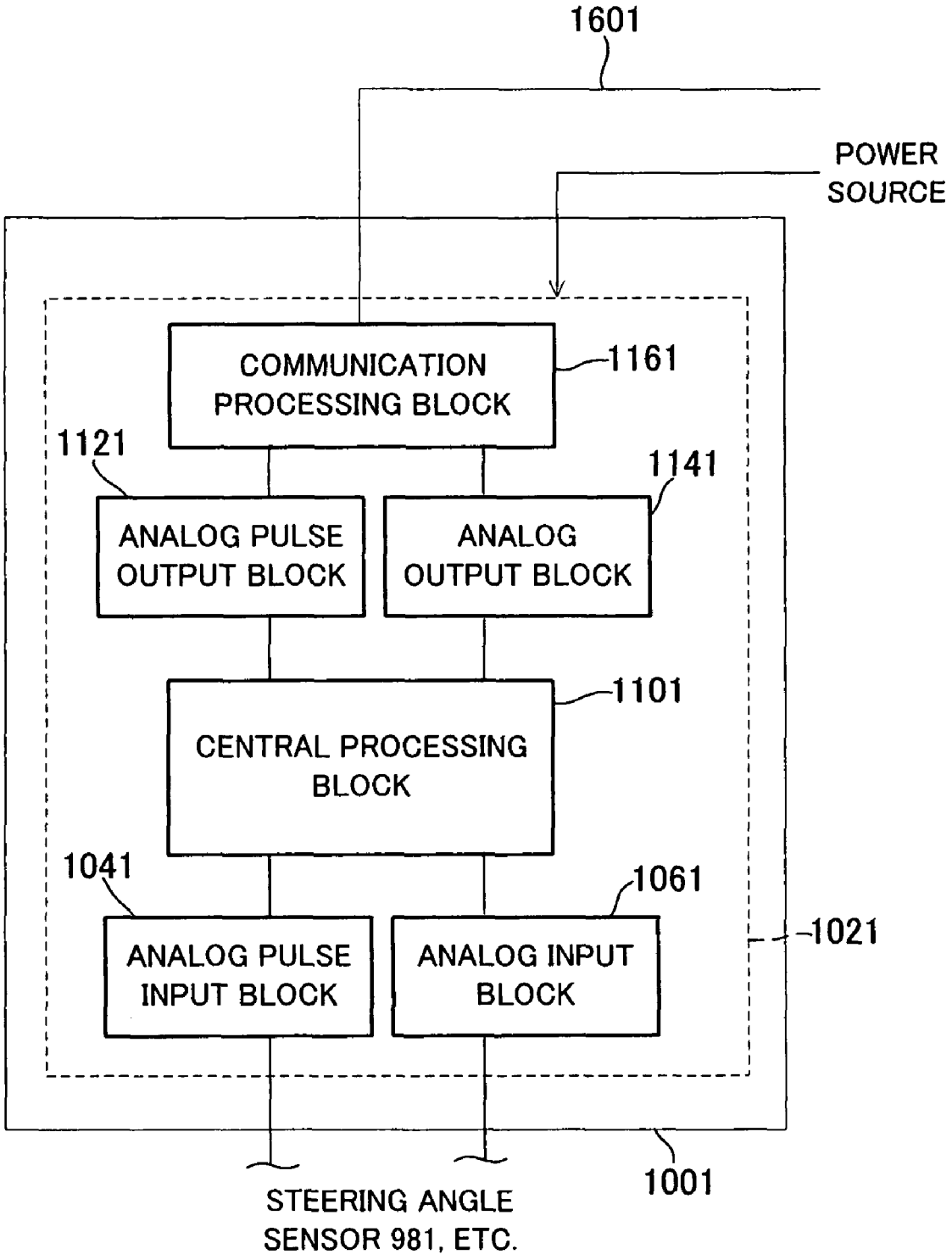
FIG. 3 is a block diagram showing the structure of a steering angle sensor unit shown in FIG. 1.

FIG. 3 is a block diagram showing the structure of the steering angle sensor unit 1001. It should be noted, although the explanation will be made with respect to the steering angle sensor unit 1001 in the following, since the configurations of the steering angle sensor units 1001, 1002 are substantially the same, the explanation below can also be applied to the steering angle sensor unit 1002.

As shown in FIG. 3, the steering angle sensor unit 1001 is equipped with a main processing section 1021 and the like. The main processing section 1021 comprises an analog pulse input block 1041 and analog input block 1061 that are connected to the steering angle sensor 981 (not shown in FIG. 3) and the like to be inputted with the detected steering angle etc., a central processing block 1101 that is connected to the analog pulse input block 1041 and analog input block 1061 and based on the steering angle, carries out appropriate calculation, an analog pulse output block 1121 and analog output block 1141 that are connected to the central processing block 1101 to output the calculated value indicative of the steering angle, and a communication processing block 1161 that is connected to the analog pulse output block 1121 and analog output block 1141 and outputs or forwards the outputted value to the lever position sensor unit (explained later) and the like. The main processing section 1021 of the steering angle sensor unit 1001 is connected to the power source of the outboard motor 12 to be supplied with operating power.

The explanation of the navigation units 901, 902 in FIG. 1 will be resumed. The remote control boxes 941*a, b, c*, 942*a, b, c* are equipped with shift/throttle levers 1201*a, b, c*, 1202*a, b, c* installed to be freely swung or manipulated by the operator. The shift/throttle levers 1201*a, b, c*, 1202*a, b, c* are used by the operator to input shift position change commands (commands for operating the shift motors 66*a, b, c*) and engine speed regulation commands (commands for operating the throttle motors 40*a, b, c*).

Lever position sensors (manipulated variable detector; lever position detector) 1221*a, b, c*, 1222*a, b, c* are installed near the shift/throttle levers 1201*a, b, c*, 1202*a, b, c*. The lever position sensors 1221*a, b, c*, 1222*a, b, c* produce outputs or signals indicative of the manipulated variables or manipulated positions of the shift/throttle levers 1201*a, b, c*, 1202*a, b, c* by the operator, i.e., lever positions.

The lever position sensors 1221*a, b, c*, 1222*a, b, c* are connected to lever position sensor units (shift/throttle sensor unit; manipulated variable detector; lever position detector) 1241*a, b, c*, 1242*a, b, c* that are inputted with outputs indicative of the lever positions detected by the lever position sensors.

Figure 4:
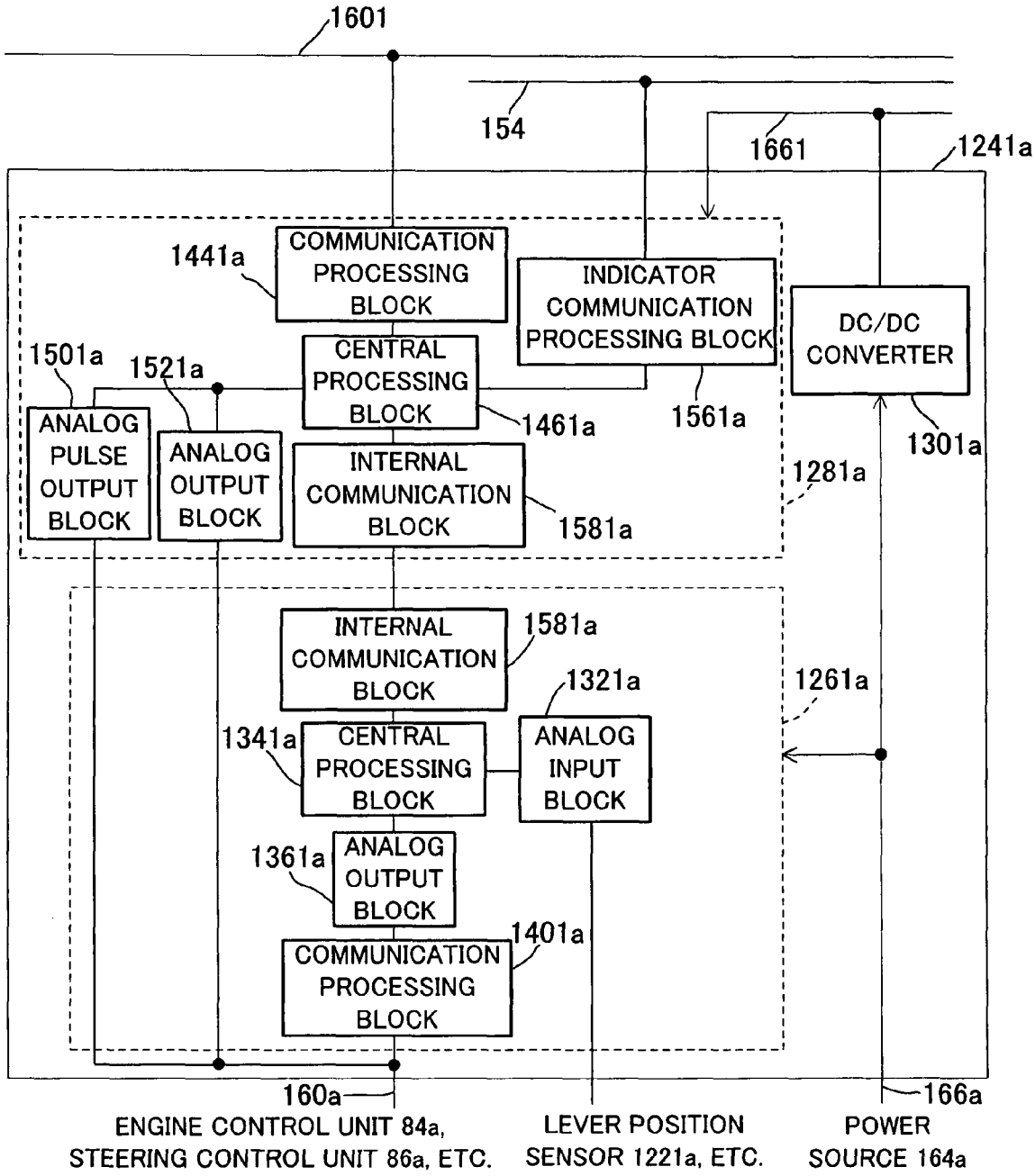
FIG. 4 is a block diagram showing the structure of a lever position sensor unit shown in FIG. 1.

FIG. 4 is a block diagram showing the structure of the lever position sensor unit 1241*a*. It should be noted, although the explanation will be made with respect to the lever position sensor unit 1241*a* in the following, since the configurations of the other lever position sensor units 1241*b, c*, 1242*a, b, c* are substantially the same, the explanation below can be applied to the lever position sensor units 1241*b, c*, 1242*a, b, c*.

As shown in FIG. 4, the lever position sensor unit 1241*a* is equipped with a main processing section 1261*a*, isolation section 1281*a*, DC/DC converter 1301*a* and the like. The main processing section 1261*a* comprises an analog input block 1321*a* that is connected to the lever position sensor 1221*a* (not shown in FIG. 4) and the like to be inputted with the detected lever position etc., a central processing block 1341*a* that is connected to the analog input block 1321*a* and based on the lever position, carries out appropriate calculation, an analog output block 1361*a* that is connected to the central processing block 1341*a* to output the calculated value indicative of the lever position, and a communication processing block 1401*a* that is connected to the analog output block 1361*a* and outputs or forwards the outputted value to the engine control unit 84*a* and the like.

The isolation section 1281*a* comprises a communication processing block 1441*a* connected to the steering angle sensor unit 1001, precisely the communication processing block 1161 of the steering angle sensor unit 1001 (neither shown in FIG. 4) and the like, to be inputted with a value indicative of steering angle, a central processing block 1461*a* that is connected to the communication processing block 1441*a* and based on the steering angle, carries out appropriate calculation, an analog pulse output block 1501*a* and analog output block 1521*a* that are connected to the central processing block 1461*a* to output the calculated value indicative of the steering angle to the steering control unit 86*a* etc., an indicator communication processing block 1561*a* connected to the central processing block 1461*a* to output values indicative of the steering angle etc. to the indicator 961 and the like through an electric signal line 154. The main processing section 1261*a* and isolation section 1281*a* are equipped with internal communication blocks 1581*a*. Interconnection of the internal communication blocks 1581*a* enables signals to be sent to and received by each other.

Next, the connections between the steering angle sensor units 1001, 1002 and lever position sensor units 1241*a, b, c*, 1242*a, b, c* installed in the boat 10, and the engine control units 84*a, b, c* and steering control units 86*a, b, c* installed in the three outboard motors 12*a, b, c*, will be explained.

Figure 5:
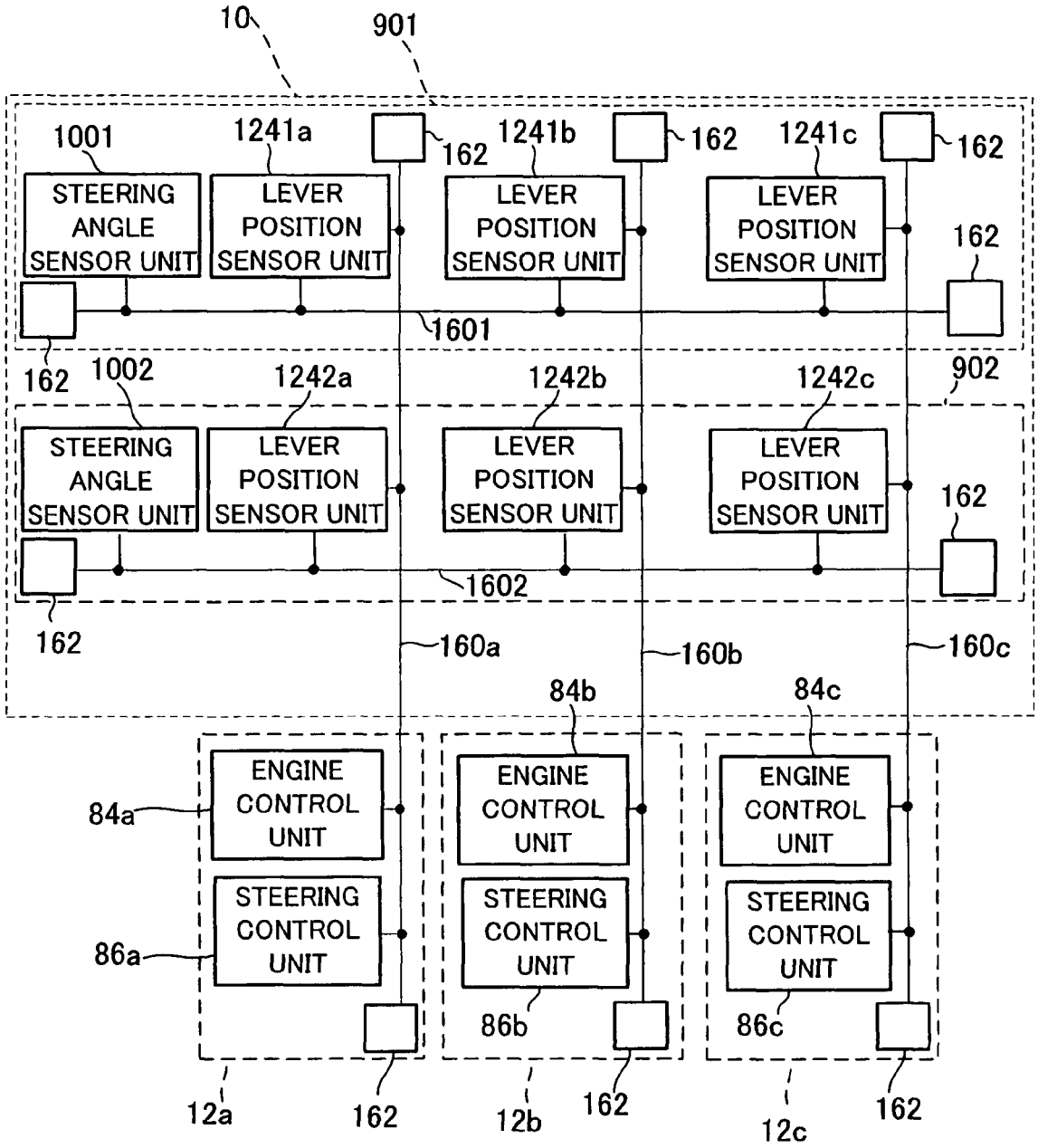
FIG. 5 is a view explaining connections between units shown in FIG. 1.

FIG. 5 is a view explaining the connections between the units. In FIG. 5, merely the units and electric signal lines connecting them are illustrated for ease of understanding.

Figure 8:
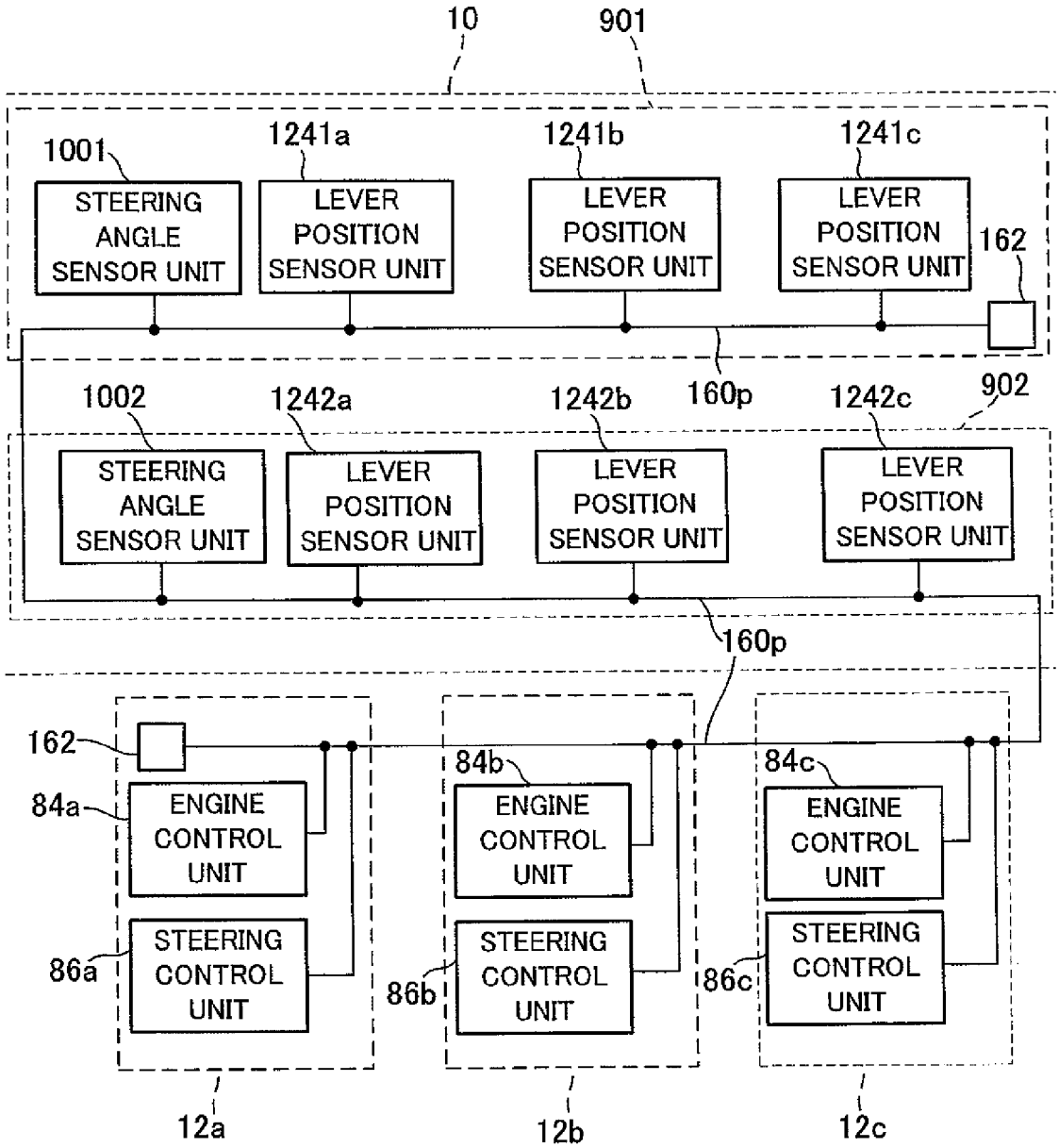
FIG. 8 is a view similar to FIG. 5 but explaining a prior art outboard motor control system.

Before making the explanation with reference to FIG. 5, the object of this invention will be again explained. Conventionally, when multiple outboard motors are attached to a boat, as shown in FIG. 8, the steering angle sensor units 1001, 1002 and lever position sensor units 1241*a, b, c*, 1242*a, b, c* in the boat are connected to the engine control units 84*a, b, c* and steering control units 86*a, b, c* in the multiple outboard motors in series through an electric signal line (digital communication line) 160*p*. The both ends of the signal line 160*p* are connected to communication stabilizers 162 each composed of a resistor for stabilizing communication by fixing impedance in a communication circuit.

However, with this configuration in which the units are connected in series through the one electric signal line 160*p*, when the operation of the actuators, i.e., the steering motors 24*a, b, c*, throttle motors 40*a, b, c*, shift motors 66*a, b, c*, of the outboard motors 12 is controlled for each of the outboard motors, it is necessary to identify the respective outboard motors, i.e., to rewrite software for each of the outboard motors, resulting in increase of complicated tedious work.

In this embodiment, therefore, it is configured to connect the steering angle sensor units 1001, 1002 and lever position sensor units 1241*a, b, c*, 1242*a, b, c* installed in the boat 10 to the engine control units 84*a, b, c* and steering control units 86*a, b, c* installed in the three outboard motors 12*a, b, c* through electric signal lines (digital communication lines) separately, i.e., in parallel for the individual outboard motors.

The details will be explained in reference to FIG. 5. The steering angle sensor unit 1001 (precisely, the communication processing block 1161 (not shown in FIG. 5) of the steering angle sensor unit 1001) of the first navigation unit 901 is connected to the lever position sensor units 1241*a, b, c* (precisely, the communication processing block 1441*a, b, c* (not shown) of the lever position sensor units 1241*a, b, c*) through an electric signal line 1601. Similarly, the steering angle sensor unit 1002 of the second navigation unit 902 is connected to the lever position sensor units 1242*a, b, c* through an electric signal line 1602.

The lever position sensor unit 1241*a* (precisely, the communication processing block 1401*a*, analog pulse output block 1501*a* and analog output block 1521*a* (not shown in FIG. 5) of the lever position sensor unit 1241*a*) of the first navigation unit 901 and the lever position sensor unit 1242*a* (precisely, the communication processing block 1402*a*, analog pulse output block 1502*a* and analog output block 1522*a* (not shown) of the lever position sensor unit 1242*a*) of the second navigation unit 902 are connected to the engine control unit 84*a* and steering control unit 86*a* of the port outboard motor 12*a* through an electric signal line 160*a*.

Similarly, the lever position sensor unit 1241*b* of the first navigation unit 901 and the lever position sensor unit 1242*b* of the second navigation unit 902 are connected to the engine control unit 84*b* and steering control unit 86*b* of the middle outboard motor 12*b* through an electric signal line 160*b*. The lever position sensor unit 1241*c* of the first navigation unit 901 and the lever position sensor unit 1242*c* of the second navigation unit 902 are connected to the engine control unit 84*c* and steering control unit 86*c* of the starboard outboard motor 12*c* through an electric signal line 160*c*. The electric signal lines 1601, 1602, 160*a, b, c* are each connected at its both ends with the communication stabilizers 162.

The operation of the outboard motor control system thus configured will be explained taking the first navigation unit 901 and port outboard motor 12*a* as an example. The steering angle sensor unit 1001 determines a desired rudder angle of the port outboard motor 12*a* (i.e., desired rudder angle of the three outboard motors 12*a, b, c* because the outboard motors 12*a, b, c* are steered in a synchronized manner) based on the output of the steering angle sensor 981, and sends the determined desired rudder angle to the steering control unit 86*a* through the electric signal line 160*a*. The steering control unit 86*a* controls the operation of the steering motor 24*a* so that the output of the rudder angle sensor 76*a* becomes equal to the desired rudder angle.

The lever position sensor unit 1241*a* determines a desired shift position based on the output of the lever position sensor 1221*a* (namely, the direction of manipulation of the shift/throttle lever 1201*a*) and sends an output or signal indicative of the desired shift position to the engine control unit 84*a* through the electric signal line 160*a*. The engine control unit 84*a* controls the operation of the shift motor 66*a* so that the output of the shift position sensor 74*a* becomes equal to the desired shift position.

When it is detected from the output of the shift position sensor 74*a* that the desired shift position has been established (shift position change has been completed), the lever position sensor unit 1241*a* determines a desired throttle opening based on the output of the lever position sensor 1221*a* (namely, the amount of manipulation of the shift/throttle lever 1201*a*) and sends an output or signal indicative of the desired throttle opening to the engine control unit 84*a* through the electric signal line 160*a*. The engine control unit 84*a* controls the operation of the throttle motor 40*a* so that the output of the throttle opening sensor 72*a* becomes equal to the desired throttle opening.

Thus two kinds of signals, i.e., the output of the steering angle sensor unit 1001 (signal indicating the steering angle) and the output of the lever position sensor unit 1241*a* (signal indicating the lever position) are forwarded to the engine control unit 84*a* or steering control unit 86*a* through the electric signal line 160*a*.

The operation of the lever position sensor unit 1241*b* with the middle outboard motor 12*b* and the lever position sensor unit 1241*c* with the starboard outboard motor 12*c* is substantially the same as that of the lever position sensor unit 1241*a* with the port outboard motor 12*b*, so the explanation will be omitted. Also, the operation of the second navigation unit 902 will not be explained due to its operation same as that of the first navigation unit 901.

As described, the outboard motor control system according to this embodiment is a DBW (Drive By Wire) control system without any mechanical connection between the navigation units and the outboard motors, and the lever position sensor units 1241*a, b, c*, 1242*a, b, c* installed in the boat 10 are connected to the engine control units 84*a, b, c* and steering control units 86*a, b, c* installed in the three outboard motors 12*a, b, c* through the electric signal lines 160*a, b, c* separately, i.e., in parallel for the individual outboard motors. With this, it becomes possible to control the operation of the actuators installed in the outboard motors separately for the individual outboard motors in spite of simple structure, specifically, without work to identify the respective outboard motors.

Further, since it is configured such that the outputs of the steering angle sensor units 1001, 1002 and outputs of the lever position sensor units 1241*a, b, c*, 1242*a, b, c* are sent to the engine control units 84*a, b, c* or steering control units 86*a, b, c* through the electric signal lines 160*a, b, c*, specifically, the two kinds of signals are sent through the electric signal lines, the lever position sensor unit installed in the boat can be connected to the engine control unit and steering control unit installed in the outboard motor via the one electric signal line, thereby enabling to simplify the structure.

Next, an operating power source of the outboard motor control system, specifically, a power source that supplies operating power to the lever position sensor units 1241*a, b, c*, 1242*a, b, c* will be explained.

Figure 6:
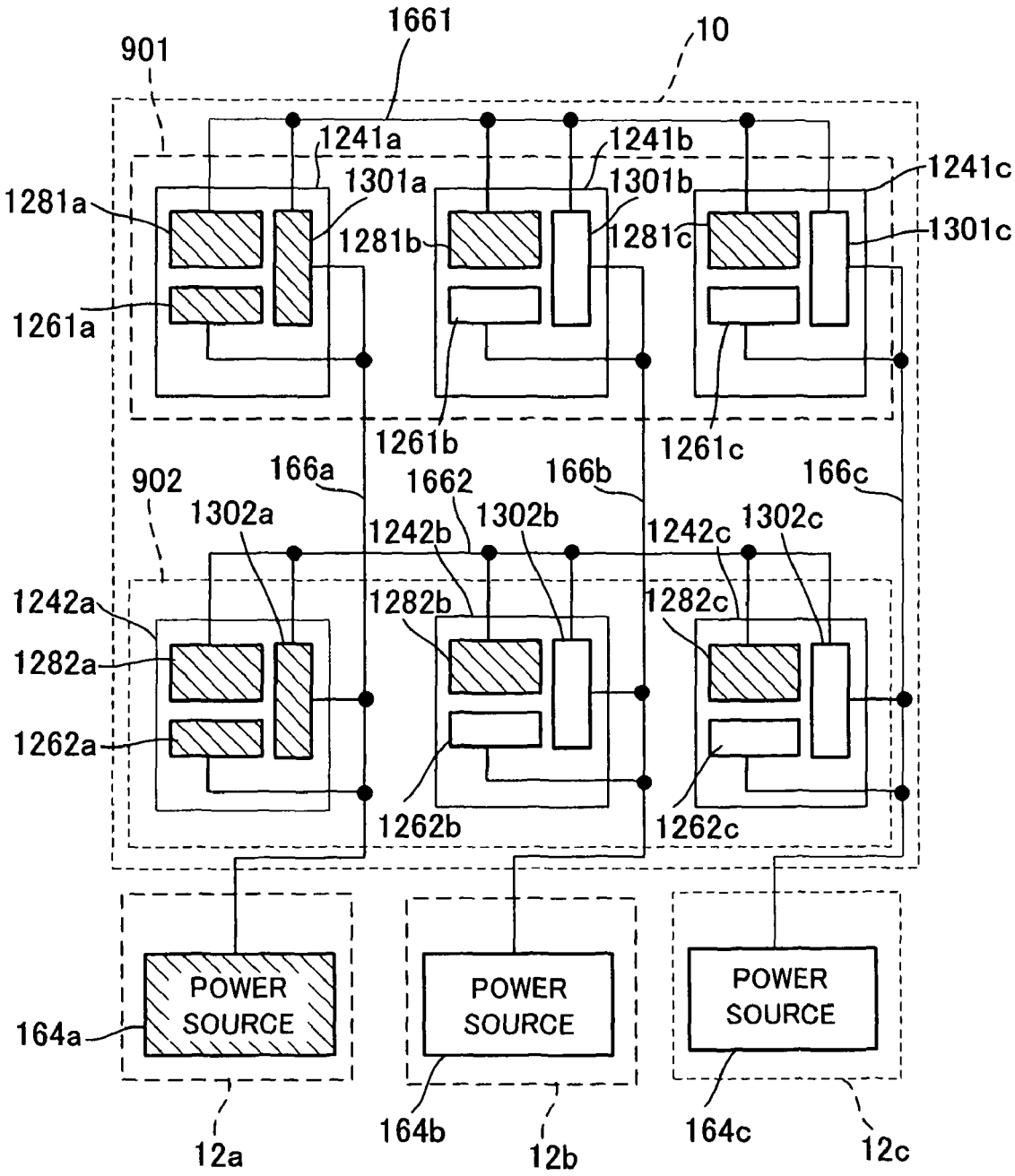
FIG. 6 is a view explaining supply of operating power to the lever position sensor units shown in FIG. 1.

FIG. 6 is a view explaining supply of operating power to the lever position sensor units 1241*a, b, c*, 1242*a, b, c*. In FIG. 6, merely the outboard motors, lever position sensor units and network power lines connecting them are illustrated for ease of understanding.

As shown in FIG. 6, a power source 164*a* of the port outboard motor 12*a* is connected to the main processing sections 1261*a*, 1262*a* and DC/DC converters 1301*a*, 1302*a* of the lever position sensor units 1241*a*, 1242*a* through a network power line 166*a*.

The power source 164*b* of the middle outboard motor 12*b* is connected to the main processing sections 1261*b*, 1262*b* and DC/DC converters 1301*b*, 1302*b* of the lever position sensor units 1241*b*, 1242*b* through a network power line 166*b*. Similarly, the power source 164*c* of the starboard outboard motor 12*c* is connected to the main processing sections 1261*c*, 1262*c* and DC/DC converters 1301*c*, 1302*c* of the lever position sensor units 1241*c*, 1242*c* through a network power line 166*c*.

In the first navigation unit 901, the isolation sections 1281*a, b, c* and DC/DC converters 1301*a, b, c* of the lever position sensor units 1241*a, b, c* are interconnected through a network power line 1661. In the second navigation unit 902, the isolation sections 1282*a, b, c* and DC/DC converters 1302*a, b, c* of the lever position sensor units 1242*a, b, c* are interconnected through a network power line 1662.

Specifically, the power source 164*a* of the port outboard motor 12*a* is directly connected to the main processing sections 1261*a*, 1262*a* of the lever position sensor units 1241*a*, 1242*a*, while being indirectly connected to the isolation sections 1281*a*, 1282*a* through the DC/DC converters 1301*a*, 1302*a*. The connections between the other power sources and the lever position sensor units have the same structures.

Before further explaining the network power line 166, a network power line connecting outboard motors to the lever position sensor units according to a prior art will be explained in reference to FIG. 9.

Figure 9:
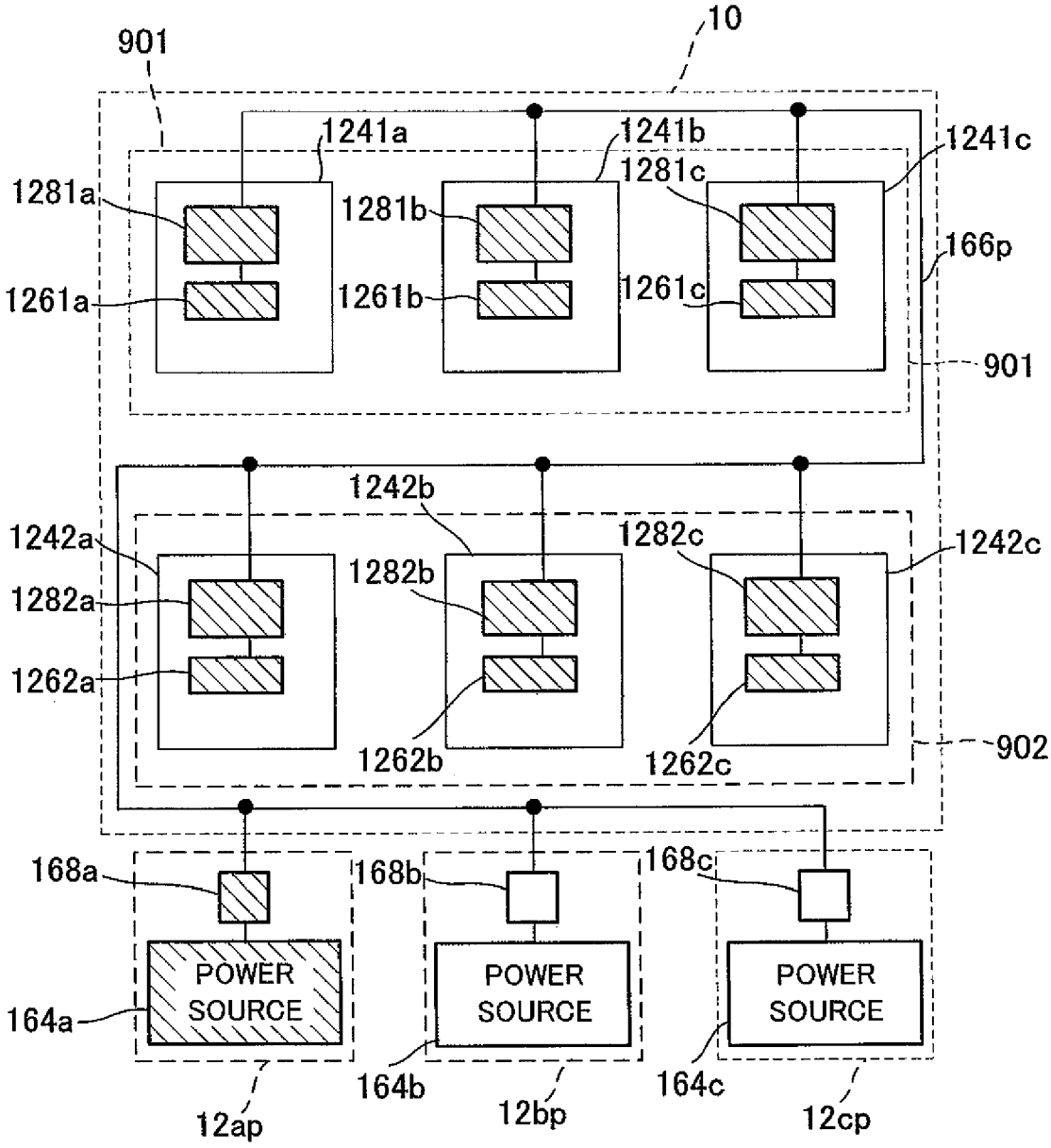
FIG. 9 is a view similar to FIG. 6 for explaining supply of operating power to a lever position sensor unit according to a prior art.

As shown in FIG. 9, DC/DC converters 168*a, b, c* mounted on outboard motors 12*ap, bp, cp* are connected to the power sources 164*a, b, c* of the outboard motors 12*ap, bp, cp*, respectively. The DC/DC converters 168*a, b, c* are connected to the lever position sensor units 1241*a, b, c* 1242*a, b, c* (i.e., the isolation sections and main processing sections of the lever position sensor units 1241*a, b, c* 1242*a, b, c*) in series through a network power line 166*p*.

Specifically, the power sources 164*a, b, c* of the outboard motors are connected to all the lever position sensor units via the corresponding DC/DC converters 168*a, b, c* mounted on the outboard motors. As a result, the operating power is supplied to the lever position sensor units 1241*a, b, c* 1242*a, b, c* by the power sources 164*a, b, c* of the outboard motors through the DC/DC converters 168*a, b, c* and network power line 166*p*.

In a boat on which multiple, i.e., three outboard motors are mounted, occasionally, merely one outboard motor among three is operated, while the other two outboard motors are stopped. In the following, the explanation will be made taking as an example the case where the port outboard motor 12*ap* is operated and the middle outboard motor 12*bp* and starboard outboard motor 12*cp* are stopped.

In the stopped outboard motors, i.e., the middle outboard motor 12*bp* and starboard outboard motor 12*cp*, although engines and engine control units thereof are stopped, their steering control units and steering motors are supplied with operating power because the outboard motors 12*bp*, 12*cp* should be steered in synchronization with the operated outboard motor, i.e., the port outboard motor 12*ap*.

As mentioned above, the drive command to the steering control unit is inputted from the steering wheel by manipulation by the operator and transmitted through the steering angle sensor unit, lever position sensor unit and the like to the steering control unit. Therefore, in this case, the lever position sensor units 1241*b, c*, 1242*b, c* (i.e., isolation sections 1281*b, c*, 1282*b, c* of the lever position sensor units) corresponding to the stopped middle and starboard outboard motors 12*bp*, 12*cp* are also needed to be supplied with operating power to be operated.

Specifically, as shown in FIG. 9, operating power supplied by the power source 164*a* of the port outboard motor 12*ap* which is operated, is supplied to the lever position sensor units 1241*b, c*, 1242*b, c* corresponding to the middle and starboard outboard motors 12*b, c* which are stopped, in addition to the lever position sensor units 1241*a*, 1242*a*. With this, the outputs of the lever position sensor units 1241*b, c*, 1242*b, c* are continuously sent to the steering control units to steer the middle and starboard outboard motors 12*bp*, 12*cp*. In FIG. 9, the portions to be supplied with operating power are marked with diagonal lines.

Due to this configuration, when, for instance, the power consumption of the main processing section 1261*a* and that of the isolation section 1281*a* is both 10 watts, the capacity of the DC/DC converter 168*a* of the port outboard motor 12*ap* needs to be 120 watts in order to supply operating power to all the lever position sensor units 1241*a, b, c*, 1242*a, b, c*. As a result, the DC/DC converters mounted on the outboard motors should have the relatively large capacity and it may cause a difficulty in ensuring network power. In addition, as the capacity becomes large, the DC/DC converter increases in size, resulting in increase of the outboard motor size disadvantageously.

In this embodiment, therefore, the DC/DC converter is installed in the lever position sensor unit in order to discontinue transmitting an output of the lever position sensor unit to the controller, i.e., engine control unit of the outboard motor that does not need to receive the output from the lever position sensor unit. In other words, it is configured to discontinue transmitting an output of the lever position sensor unit to the engine control unit by ceasing supplying operating power to a section (the main processing section) that transmits the output to the engine control unit of the stopped outboard motor.

Specifically, as shown in FIG. 6, operating power from the power source 164*a* of the port outboard motor 12*a* is supplied to the main processing sections 1261*a*, 1262*a* of the lever position sensor units 1241*a*, 1242*a*, and in the first navigation unit 901, to the isolation section 1281*a* through the DC/DC converter 1301*a* and network power line 1661, and the isolation sections 1281*b, c* of the lever position sensor units 1241*b, c* corresponding to the stopped middle and starboard outboard motors 12*b, c*. In the second navigation unit 902, operating power is similarly supplied to the isolation section 1282*a* through the DC/DC converter 1302*a* and network power source line 1662, and the isolation sections 1282*b, c* of the lever position sensor units 1242*b, c* corresponding to the stopped middle and starboard outboard motors 12*b, c*.

On the other hand, since the middle and starboard outboard motors 12*b, c* are stopped, operating power from the power sources 164*b, c* of the outboard motors 12*b, c* is not supplied. Specifically, operating power is not supplied to the main processing sections 1261*b, c*, 1262*b, c* of the lever position sensor units 1241*b, c*, 1242*b, c* corresponding to the stopped outboard motors 12*b*, 12*c*, thereby discontinuing forwarding an output to the engine control units of the outboard motors 12*b*, 12*c*.

As can be seen from FIG. 6, the DC/DC converter 1301*a* is configured to supply operating power to the three isolation sections 1281*a, b, c*, hence it suffices if it has the capacity of 30 watts, thereby enabling to prevent the whole system including the DC/DC converter and outboard motor from increasing in size. The same can be applied to the other DC/DC converters 1301*b, c*, 1302*a, b, c*.

Thus, it is configured to discontinue transmitting an output of the lever position sensor unit to the engine control unit of the stopped outboard motor among the plural outboard motors, specifically to discontinue transmitting an output of the lever position sensor unit to the engine control unit of the outboard motor that does not need to receive the output from the lever position sensor unit by ceasing supplying operating power to the lever position sensor unit (specifically, the main processing section of the lever position sensor unit). Owing to the configuration, it becomes possible to decrease the capacity of the DC/DC converters 1301*a, b, c*, 1302*a, b, c* and decrease power consumption of portions related to communication between the lever position sensor units 1241*a, b, c*, 1242*a, b, c* and engine control units 84*a, b, c*, thereby achieving good cost performance.

Next, an outboard motor control system according to a second embodiment of this invention will be explained.

Figure 7:
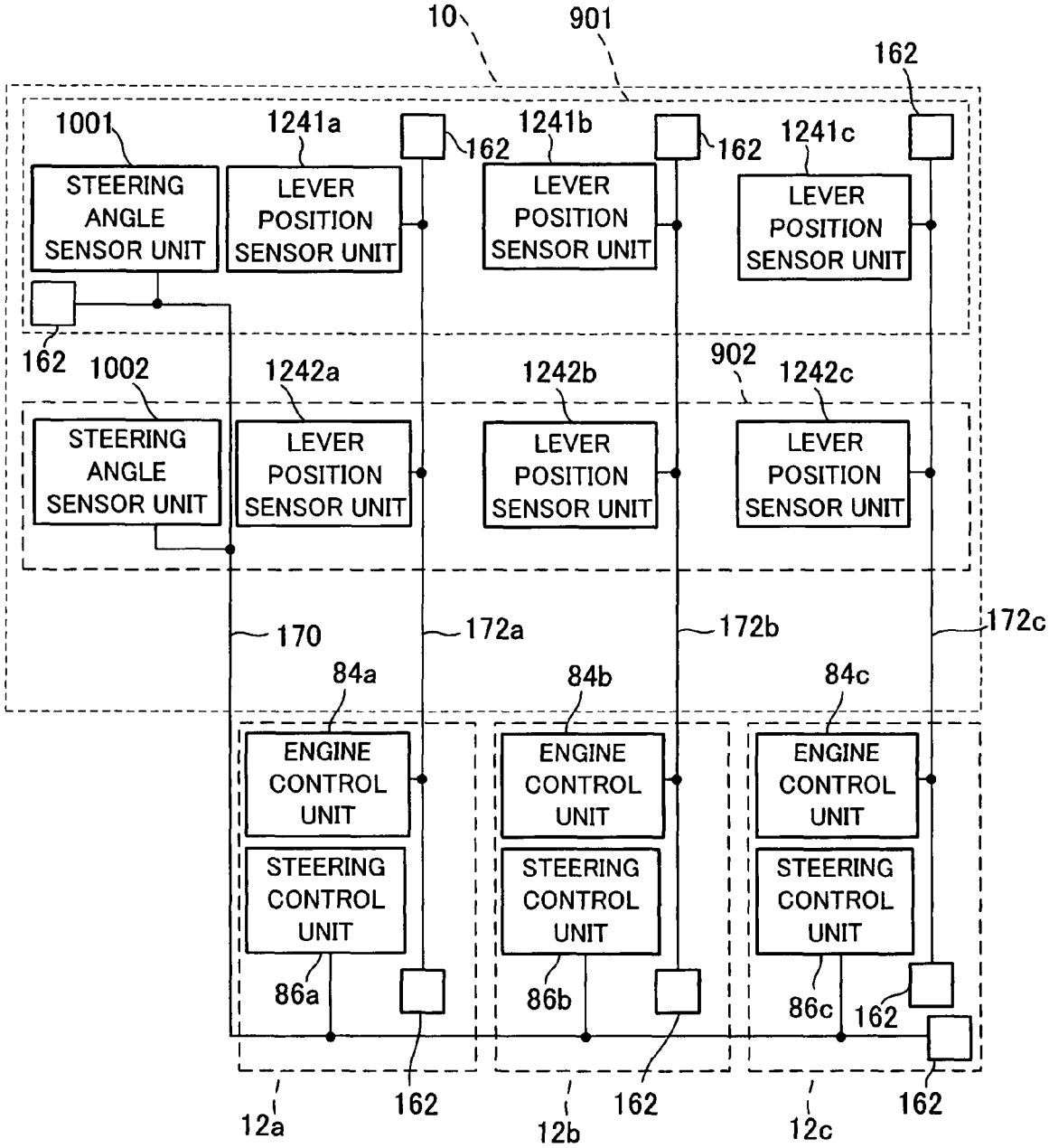
FIG. 7 is a view similar to FIG. 5 but explaining an outboard motor control system according to a second embodiment of this invention.

FIG. 7 is a view similar to FIG. 5 but explaining the outboard motor control system according to the second embodiment.

The explanation will be made with focus on points of difference from the first embodiment. In the second embodiment, as shown in FIG. 7, the steering angle sensor unit 1001 of the first navigation unit 901, the steering angle sensor unit 1002 of the second navigation unit 902 and the steering control units 86*a, b, c* of the outboard motors 12*a, b, c* are connected in series through an electric signal line, i.e., first signal line 170. The lever position sensor unit 1241*a* of the first navigation unit 901, the lever position sensor unit 1242*a* of the second navigation unit 902 and the engine control unit 84*a* of the port outboard motor 12*a* are connected through an electric signal line, i.e., second signal line 172*a*.

Similarly, the lever position sensor units 1241*b*, 1242*b* of the first and second navigation units 901, 902 and the engine control unit 84*b* of the middle outboard motor 12*b* are connected through an electric signal line, i.e., second signal line 172*b*. The lever position sensor units 1241*c*, 1242*c* of the first and second navigation units 901, 902 and the engine control unit 84*c* of the starboard outboard motor 12*c* are connected through an electric signal line, i.e., second signal line 172*c*.

Specifically, the lever position sensor units 1241*a, b, c*, 1242*a, b, c* are connected to the engine control units 84*a, b, c* installed in the outboard motors 12*a, b, c* in parallel through the electric signal lines 172*a, b, c*, respectively. With this, in the second embodiment of the invention, similar to the first embodiment, it becomes possible to control the operation of the actuators installed in the outboard motors separately for the individual outboard motors in spite of simple structure, specifically, without setting IDs and doing other works.

The remaining configuration is the same as that in the first embodiment.

As stated above, it is configured in the first and second embodiments to have a system for controlling a plurality of, i.e., three outboard motors 12*a, b, c* each adapted to be mounted on a stem of a boat 10 and each having an internal combustion engine 30, a steering mechanism (mount frame 20), a shift mechanism 44, an actuator (electric steering motor 24*a, b, c*, electric throttle motor 40*a, b, c*, electric shift motor 66*a, b, c*) adapted to drive at least one of the steering mechanism, the shift mechanism and a throttle valve 38 of the engine, and a controller (engine control unit 84*a, b, c*, steering control unit 86*a, b, c*) to control operation of the actuator, comprising: a steering wheel 921, 922 installed to be freely operable by an operator; a shift/throttle lever 1201*a, b, c*, 1202*a, b, c* installed to be freely operable by the operator; and a manipulated variable detector (steering angle sensor 981, 982, steering angle sensor unit 1001, 1002, lever position sensor 1221*a, b, c*, 1222*a, b, c*, lever position sensor unit 1241*a, b, c*, 1242*a, b, c*) adapted to produce an output indicative of manipulated variable of at least one of the steering wheel and the shift/throttle lever by the operator; the manipulated variable detector being separately connected to each of the controllers installed in the outboard motors through an electric signal line 160*a, b, c* to send the output to each of the controllers.

In the system, the manipulated variable detector includes: a steering angle detector (steering angle sensor 981, 982, steering angle sensor unit 1001, 1002) adapted to produce an output indicative of steering angle of the steering wheel; and a lever position detector (lever position sensor 1221*a, b, c*, 1222*a, b, c*, lever position sensor unit 1241*a, b, c*, 1242*a, b, c*) adapted to produce an output indicative of a manipulated position of the shift/throttle lever; and sends the outputs to each of the controllers through the electric signal line.

In the system, the steering angle detector is connected, in series, to each of the controllers (steering control unit 86*a, b, c*) through a first one of the electric signal line (first signal line 170) to send the output thereto, while the lever position detector is connected, in parallel, to each of the controllers (engine control unit 84*a, b, c*) through a second one of the electric signal line (second signal line 172*a, b, c*) to send the output thereto.

In the system, sending of the output of the manipulated variable detector (lever position sensor unit 1241*a, b, c*, 1242*a, b, c*) to one of the controllers (engine control unit 84*a, b, c*) is discontinued when the outboard motor in which the one of the controllers is installed is out of operation.

In the system, the number of the outboard motors is three.

In the system, each end of the electric signal line is connected to a communication stabilizer 162.

In the system, the actuator is an electric motor.

Further it is configured to have a system for controlling a plurality of, i.e., three outboard motors 12*a, b, c* each adapted to be mounted on a stem of a boat 10 and each having an internal combustion engine 30, a steering mechanism (mount frame 20), a shift mechanism 44, a plurality of actuators (electric steering motor 24*a, b, c*, electric throttle motor 40*a, b, c*, electric shift motor 66*a, b, c*) each adapted to drive the steering mechanism, the shift mechanism and a throttle valve 38 of the engine, and a controller (engine control unit 84*a, b, c*, steering control unit 86*a, b, c*) to control operation of the actuators, comprising: a steering wheel 921, 922 installed to be freely operable by an operator; a shift/throttle lever 1201*a, b, c*, 1202*a, b, c* installed to be freely operable by the operator; and a manipulated variable detector (steering angle sensor 981, 982, steering angle sensor unit 1001, 1002, lever position sensor 1221*a, b, c*, 1222*a, b, c*, lever position sensor unit 1241*a, b, c*, 1242*a, b, c*) adapted to produce outputs indicative of manipulated variable of the steering wheel and the shift/throttle lever by the operator; the manipulated variable detector being separately connected to each of the controllers installed in the outboard motors through an electric signal line 160*a, b, c* to send the output to each of the controllers.

In the system, the manipulated variable detector includes: a steering angle detector (steering angle sensor 981, 982, steering angle sensor unit 1001, 1002) adapted to produce an output indicative of steering angle of the steering wheel; and a lever position detector (lever position sensor 1221*a, b, c*, 1222*a, b, c*, lever position sensor unit 1241*a, b, c*, 1242*a, b, c*) adapted to produce an output indicative of a manipulated position of the shift/throttle lever; and sends the outputs to each of the controllers through the electric signal line.

In the system, the steering angle detector is connected, in series, to each of the controllers (steering control unit 86*a, b, c*) through a first one of the electric signal line (first signal line 170) to send the output thereto, while the lever position detector is connected, in parallel, to each of the controllers (engine control unit 84*a, b, c*) through a second one of the electric signal line (second signal line 172*a, b, c*) to send the output thereto.

In the system, sending of the output of the manipulated variable detector (lever position sensor unit 1241*a, b, c*, 1242*a, b, c*) to one of the controllers (engine control unit 84*a, b, c*) is discontinued when the outboard motor in which the one of the controllers is installed is out of operation.

In the system, the number of the steering wheels is two and the number of the shift/throttle levers is the same as that of the actuators.

It should be noted that although, in the foregoing, three outboard motors are mounted or fixed on the boat 10, the invention can also be applied to multiple outboard motor installations comprising two or four outboard motors or more.

It should further be noted that the number of the steering wheel can be one or three, or more, instead of two. Also, although the number of the shift/throttle lever is configured to be the same as that of the outboard motor, it can be one, two or four, or more. The point is that, as far as the configuration enables drive commands to be inputted to the outboard motors separately, the number thereof is not a problem. In that sense, the descriptions of "a steering wheel" and "a shift/throttle lever" are used in Claims.

It should further be noted that, although the capacity of the DC/DC converters 1301*a, b, c*, 1302*a, b, c*, power consumption of the lever position sensor units 1241*a, b, c*, 1242*a, b, c*, displacement of the engine 30 and the like are indicated with specific values in the foregoing, they are only examples and not limited thereto.

It should further be noted that, although electric motors are used to exemplify all of the actuators for outboard motor steering and the like, it is possible instead to utilize hydraulic cylinders or any other kinds of actuators.

Japanese Patent Application No. 2006-313463 filed on Nov. 20, 2006, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling a plurality of outboard motors each adapted to be mounted on a stern of a boat and each having an internal combustion engine, a steering mechanism, a shift mechanism, a plurality of actuators each adapted to drive one of the steering mechanism, the shift mechanism and a throttle valve of the engine, and each of the outboard motors having a controller to control operation of the actuators of the outboard motor, the system comprising:

a steering wheel installed to be freely operable by an operator;

a shift/throttle lever installed to be freely operable by the operator; and a manipulated variable detector arrangement adapted to produce outputs indicative of manipulated variables of the steering wheel and the shift/throttle lever by the operator;

wherein the manipulated variable detector is separately connected to each of the controllers installed in the outboard motors through respective electric signal lines, and the manipulated variable detector sends the outputs to each of the controllers through the respective signal lines; and wherein said manipulated variable detector arrangement includes sensor units which detect positions of the steering wheel and the shift/throttle lever when operated by the operator, and the outputs sent by the manipulated variable detector arrangement to each of the controllers through the respective signal lines do not include any identification of the outboard motors.

2. The system according to claim 1, wherein the manipulated variable detector arrangement includes:

a steering angle detector adapted to produce an output indicative of a steering angle of the steering wheel; and a lever position detector adapted to produce an output indicative of a manipulated position of the shift/throttle lever.

3. The system according to claim 2, wherein the steering angle detector is connected, in series, to each of the controllers through a first one of the electric signal lines to send the output thereto, while the lever position detector is connected, in parallel, to each of the controllers through others of the electric signal lines to send the output thereto.

4. The system according to claim 1, comprising more than one said shift/throttle lever, wherein at least one of said shift/throttle levers is separately associated with each of the outboard motors, the manipulated variable detector arrangement includes position detectors respectively associated with the shift/throttle levers and which provide outputs of the manipulated variables of the shift throttle levers, and each said position detector includes a power converter so that sending of the output of the manipulated variable detector to a given one of the controllers is discontinued when the outboard motor in which the given one of the controllers is installed is out of operation.

5. The system according to claim 1, wherein the number of the outboard motors is three.

6. The system according to claim 1, including a plurality of communication stabilizers, respectively connected to each end of each of the electric signal lines.

7. The system according to claim 1, wherein the actuators are electric motors, and each of the controllers of the outboard motors generate drive command signals for the actuators of the associated outboard motor based on the outputs sent from the manipulated variable detector arrangement.

8. The system according to claim 1, wherein the controller of each of the outboard motors comprises a steering control unit for controlling one said actuator to drive the steering mechanism and an engine control unit for controlling another said actuator to drive at least one of the shift mechanism and the throttle valve of the engine.

9. The system according to claim 8, comprising more than one said shift/throttle lever installed to be freely operable by the operator and said manipulated variable detector arrangement includes more than one said manipulated variable detector respectively associated with said shift/throttle levers and adapted to produce outputs indicative of manipulated variables of the associated shift/throttle levers, said shift/throttle levers and manipulated variable detectors also being respectively associated in sets with said outboard motors, and said respective electric signal lines separately connect said manipulated variable detectors to the engine control units of the outboard motors.

10. The system according to claim 1, comprising first and second navigation units, said first navigation unit includes said steering wheel and one said shift/throttle lever for each of said outboard motors, and said second navigation unit includes a second steering wheel and one said shift/throttle lever for each of said outboard motors.

11. The system according to claim 1, wherein said sensor units are separate from each other and the outputs of the manipulated variable detector arrangement sent to the controllers of the outboard motors are processed by the controllers, respectively, to generate control signals for the actuators in the outboard motors.

12. A system for controlling a plurality of outboard motors each adapted to be mounted on a stern of a boat and each having an internal combustion engine, a steering mechanism, a shift mechanism, a plurality of actuators adapted to respectively drive the steering mechanism, the shift mechanism and a throttle valve of the engine, and each of the outboard motors having a controller to control operation of the actuators of the outboard motor, the system comprising:

a steering wheel installed to be freely operable by an operator;

shift/throttle levers installed to be freely operable by the operator; and manipulated variable detectors adapted to produce outputs indicative of manipulated variables of the steering wheel and the shift/throttle levers by the operator;

wherein the manipulated variable detectors are separately connected to each of the controllers installed in the outboard motors through respective electric signal lines, and the manipulated variable detectors send the outputs to each of the controllers through respective signal lines; and wherein said manipulated variable detectors are sensor units which detects positions of said steering wheel and said shift/throttle levers when operated by the operator, and the outputs sent by the manipulated variable detectors to each of the controllers through the respective signal lines do not include any identification of the outboard motors.

13. The system according to claim 12, wherein the manipulated variable detectors include: a steering angle detector adapted to produce an output indicative of steering angle of the steering wheel; and lever position detectors adapted to produce outputs indicative of a manipulated positions of respective ones of the shift/throttle levers.

14. The system according to claim 13, wherein the steering angle detector is connected, in series, to each of the controllers through a first one of the electric signal lines to send the output thereto, while the lever position detectors are connected, in parallel, to each of the controllers through others of the electric signal lines to send the output thereto.

15. The system according to claim 12, each of said shift/throttle levers is separately associated with a respective one of the outboard motors, the manipulated variable detectors include position detectors respectively associated with the shift/throttle levers and which provide outputs of the manipulated variables of the shift throttle levers, and each said position detector includes a power converter so that sending of the output of the manipulated variable detector to a given one of the controllers is discontinued when the given outboard motor in which the one of the controllers is installed is out of operation.

16. The system according to claim 12, further comprising another steering wheel installed to be freely operable by an operator and the number of the shift/throttle levers is the same as that of a total number of the actuators for controlling each of the shift mechanisms and each of the throttle valves of all of the outboard motors.

17. The system according to claim 12, wherein the controller of each of the outboard motors comprises a steering control unit for controlling one said actuator to drive the steering mechanism and an engine control unit for controlling another said actuator to drive at least one of the shift mechanism and the throttle valve of the engine.

18. The system according to claim 17, wherein ones of said manipulated variable detectors are respectively associated with said shift/throttle levers and adapted to produce outputs indicative of manipulated variables of the associated shift/throttle levers, said shift/throttle levers and manipulated variable detectors also being respectively associated in sets with said outboard motors, and said respective electric signal lines separately connect said manipulated variable detectors to the engine control units of the outboard motors.

19. The system according to claim 12, comprising first and second navigation units, said first navigation unit includes said steering wheel and a plurality of said steering/throttle levers for each of said outboard motors, and said second navigation unit includes a second steering wheel and a plurality of said shift/throttle levers for each of said outboard motors.

20. The system according to claim 12, wherein said manipulated variable detectors are separate from each other and the outputs of the manipulated variable detectors sent to the controllers of the outboard motors are processed by the controllers, respectively, to generate control signals for the actuators in the outboard motors.

* * * * *